US006196713B1

(12) United States Patent
Meis et al.

(10) Patent No.: US 6,196,713 B1
(45) **Date of Patent: *Mar. 6, 2001**

(54) DEVICE FOR ADJUSTING THE MINUTES HAND OF A WATCH WITH AT LEAST A MINUTES AND A SECONDS HAND

(75) Inventors: Reinhard Meis, Stockach; Helmut Geyer, Glashütte; Jens Schneider, Altenberg, all of (DE)

(73) Assignee: Lange Uhren GmbH, Glashütte (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/147,878

(22) PCT Filed: Sep. 2, 1997

(86) PCT No.: PCT/EP97/04767

§ 371 Date: Jun. 14, 1999

§ 102(e) Date: Jun. 14, 1999

(87) PCT Pub. No.: WO98/12609

PCT Pub. Date: Mar. 26, 1998

(30) Foreign Application Priority Data

Sep. 18, 1996 (DE) ..... 196 38 013
Jun. 18, 1997 (DE) ..... 197 25 793

(51) Int. Cl.[7] ..... G04B 27/02
(52) U.S. Cl. ..... 368/190; 368/196
(58) Field of Search ..... 368/76, 186, 190–199

(56) References Cited

U.S. PATENT DOCUMENTS 3,690,058 * 9/1972 Kurita .

FOREIGN PATENT DOCUMENTS

57090 * 8/1912 (CH) .
632373 * 10/1982 (CH) .
2008291 * 5/1979 (GB) .

* cited by examiner

*Primary Examiner*—Vit Miska
(74) *Attorney, Agent, or Firm*—Martin A. Farber

(57) ABSTRACT

An arrangement for setting the minute hand of a timepiece which has at least minute and second hands 29, having a setting stem 1 which can be moved axially out of a normal position into a setting position. In this case, upon movement of the setting stem 1 out of the normal position into the setting position, a zero setting drive of the second hand 29 can be driven such that it moves the latter into its zero position. By virtue of the setting stem 1 being moved out of the normal position in the direction of the setting position, it is possible to initiate operation of a spring-force-operated drive by means of which the zero setting drive of the second hand 29 can be driven such that it moves the latter into its zero position.

37 Claims, 4 Drawing Sheets

DEVICE FOR ADJUSTING THE MINUTES HAND OF A WATCH WITH AT LEAST A MINUTES AND A SECONDS HAND

FIELD AND BACKGROUND OF THE INVENTION

The invention relates to an arrangement for setting the minute hand of a timepiece which has at least minute and second hands, having a setting stem which can be moved axially out of a normal position into a setting position, it being the case that, upon movement of the setting stem out of the normal position into the setting position, a zero setting drive of the second hand can be driven such that it moves the latter into its zero position.

The disadvantage of a known arrangement of this type is that the second hand can only be moved fully into the zero position when the setting stem is forced right into its setting position. If this is not the case, the second hand is only moved more or less, but not fully, into the zero position.

SUMMARY OF THE INVENTION

The object of the invention is thus to provide an arrangement of the type mentioned in the introduction which, while being straightforward to actuate, carries out rapid and complete zero setting of the second hand for the purpose of minute time setting.

This object is achieved according to the invention in that, by virtue of the setting stem being moved out of the normal position in the direction of the setting position, it is possible to initiate operation of a spring-force-operated drive by means of which the zero setting drive of the second hand can be driven such that it moves the latter into its zero position. All that is necessary here is for the setting stem to be moved by a certain minimum distance out of the normal position in the direction of the setting position, without having to reach the setting position fully in order to initiate operation of the drive. This drive then ensures independently that the second hand is moved fully into the zero position.

The setting stem may serve exclusively for the zero setting of the second hand.

If the setting stem is a minute setting stem of the timepiece and the setting position is the minute setting position, in which, by virtue of rotation of the setting stem, the minute hand can be driven such that it can be moved manually, then the setting stem fulfils both the function of initiating operation of the zero setting drive and the function of actuating the minutes setting. Movement of the setting stem into its minute position alone automatically brings about zero setting of the second hand.

If, when the setting stem is located in the setting position, the second hand can be arrested in the zero position by the zero setting drive, then the second hand remains in its zero position until the setting operation of the minute hand has been completed and the timepiece is to be restarted precisely in accordance with, for example, a time signal.

For the purpose of initiating the operation of the drive, it is possible for the lever, in straightforward and space-saving form, to be a two-armed lever, in particular a two-armed angle lever.

A reliably functioning construction of straightforward configuration is achieved if the zero setting drive is a cam-plate drive, of which the cam plate is arranged fixedly on the seconds stem, which bears the second hand, and, upon movement of the setting stem in the direction of the setting position, can be driven by the spring-force-operated drive such that it can be moved into the zero position by a zero setting lever, it being the case that the cam-plate drive is preferably a heart-cam zero setting drive. If the cam plate can be arrested in the zero position by the zero setting lever, then these components serve not just for movement into the zero position, but also for keeping the second hand in the zero position.

Just a small amount of installation space is required if the zero setting lever is a lever which can be pivoted about a spindle parallel to the seconds stem and which acts on the radially peripheral lateral surface of the cam plate.

A straightforward and space-saving setting drive is achieved in that the zero setting drive has a pivot lever which can be pivoted, about a pivot spindle parallel to the seconds stem, between a normal position and a zero setting position, which is forced into its zero setting position by spring action and which can act on the zero setting lever such that it can be moved out of its normal position, in which it is spaced apart from the cam plate, against the cam plate, The drive may be formed in that, by virtue of the lever, a control plate can be driven such that it can be pivoted about a spindle parallel to the spindle of the lever, it being the case that the control plate has a control curve which can act on an activation surface of the pivot lever, and the pivot lever can be moved out of its normal position into its zero setting position counter to the action of its spring.

If, in this case, the control curve and activation surface are inclined with respect to one another at an angle at which self-locking is ruled out, then the control curve and activation surface slide along one another under the force of the spring action and cause the pivot lever to pivot.

The control curve may be an arc which is equidistant from the spindle of the control plate, and the activation surface may be a slope which is inclined with respect to a radial line to the pivot spindle of the pivot lever, it being the case that, for reasons of the small amount of installation space required, the control curve is an arc section which, in the rest position, butts against the slope of the pivot lever and, in the zero setting position, is disengaged from the slope of the pivot lever.

If the control plate can be pivoted freely relative to the lever over a certain distance, then, at the end of the sliding operation between the control plate and slope, it is disengaged from the slope, as a result of which the spring force acting on the pivot lever serves fully for the purpose of driving the zero setting drive.

The certain distance is limited in a straightforward manner in that arranged on the lever is a stub which engages in a groove which belongs to the control plate and extends over the certain distance in the radial direction in relation to the spindle of the control plate.

In order for the setting stem always to be kept in a defined manner in one of its end positions and, furthermore, for the pivot movement of the lever to be accelerated, it is possible, depending on its pivot position, for the lever to be forced into its rest position or its hand setting position by the action of a catch spring.

If, when the setting stem is located in the setting position, the second hand can be arrested in the zero position by the zero setting drive, then the second hand remains in its zero position until the setting operation of the minute hand has been completed and the timepiece is to be restarted precisely in accordance with, for example, a time signal. For this purpose, by virtue of the setting stem, when the latter is moved out of the normal position into the setting position, a stopping device can be actuated for the purpose of stopping the movement mechanism for the timepiece. This can take place in a straightforward manner in that the stopping device can be actuated by the pivot lever.

The stopping device may have a stopping lever which can be driven such that it can be moved, by the pivot lever, between a normal position, in which it releases the balance wheel of the timepiece, and a stopping position, in which it acts on the balance wheel with a force fit, it being the case that the pivot lever can preferably act on the stopping lever such that it forces said stopping lever away from the balance wheel in the radial direction counter to the force of a spring. For this purpose, that region of the stopping lever which acts on the balance wheel with a force fit is preferably a spring arm.

In order to be able to carry out zero setting of the second hand without the drive of the movement mechanism being affected thereby, the seconds stem may be coupled to the movement mechanism of the timepiece with a force fit.

For this purpose, in a straightforward embodiment, there may be arranged between the seconds stem and a seconds-display drive mechanism of the movement mechanism a prestressed coupling spring which butts against at least either the seconds stem or the seconds-display drive mechanism with a friction fit.

A space-saving embodiment is achieved in that the seconds-display drive mechanism is mounted on the seconds stem in a freely rotatable manner, it being possible, without any great amount of installation space being required, for the coupling spring to be arranged axially between the seconds stem and seconds-display drive mechanism.

Both a straightforward construction of the coupling spring and concentric loading of the components on which the coupling spring acts are achieved if the coupling spring is a spring which has one or more radially directed spring arms, of which one spring-arm end is arranged on the seconds stem and the second spring-arm end is supported on the end side of the seconds-display drive mechanism, it being possible for the second spring-arm end to be supported on a radially directed, flange-like widened section of the seconds-display drive mechanism.

As a result of production tolerances, there is always play in the wheel train leading to the seconds-display drive mechanism, and this play has to be overcome upon a zero setting movement of the second hand in the counterclockwise direction. If the second hand is then driven again in normal operation, the play in the wheel train must first be overcome before the second hand is moved. This results in the starting of the second hand being delayed, and thus in the time display being incorrect by from 1 to 2 seconds. In order to ensure that the second hand starts correctly, the seconds-display drive mechanism may have a blocking device which can be actuated, by virtue of the setting stem being moved in the direction of the setting position, such that the seconds-display drive mechanism is blocked before the second hand is moved into the zero position. This means that the second-display drive mechanism is blocked before the zero setting movement of the second hand, with the result that the wheel train remains free of play in the normal drive direction.

In a straightforward configuration, the blocking device may have a blocking lever which can be pivoted about a pivot spindle and which can act on a movable drive part of the seconds-display drive mechanism with a force fit and/or form fit and/or friction fit.

Fulfilling a double function, and thus saving space, the movable drive part may be the flange-like widened section of the seconds-display drive mechanism, of which the radially peripheral lateral surface can have the blocking lever acting on it.

The seconds-display drive mechanism is blocked particularly reliably in that the radially peripheral lateral surface has a radially peripheral approximately V-shaped groove into which the blocking lever, which can be pivoted about the pivot spindle parallel to the axis of rotation of the gear wheel, can be pivoted by way of an approximately correspondingly V-shaped blocking region.

If the blocking lever can be driven such that it can be pivoted by the pivot lever, then the pivot lever fulfils more than one function at the same time.

Blocking of the seconds-display drive mechanism before the second hand is moved into the zero position is achieved, in a straightforward construction, in that the pivot spindle of the blocking lever and the spindle of the zero setting lever are arranged axially with respect to one another, and the blocking engagement direction of the blocking lever and the zero setting direction of the zero setting lever are oriented in approximately the same way.

If the action of a blocking spring forces the blocking lever both in the blocking engagement direction and against the pivot lever, such that the latter is forced into the zero setting position, then the blocking lever, following its blocking engagement, can easily be released from the pivot lever and this can move on further in relation to the cam plate of the cam-plate drive. For this purpose, a straightforward construction consists in that the action of the blocking spring forces the blocking lever into abutment against a stop of the pivot lever or of the zero setting lever, it being the case that, when the blocking lever and pivot lever are respectively pivoted in the blocking engagement direction and the zero setting direction, the blocking lever can reach the blocking position before the zero setting lever reaches the zero setting position.

BRIEF DESCRIPTION OF THE DRAWINGS

An exemplary embodiment of the invention is described in more detail hereinbelow and is illustrated in the drawings, in which.

DETAILED DESCRIPTION OF THE PREFERRED EMBODIMENT

Figure 1:
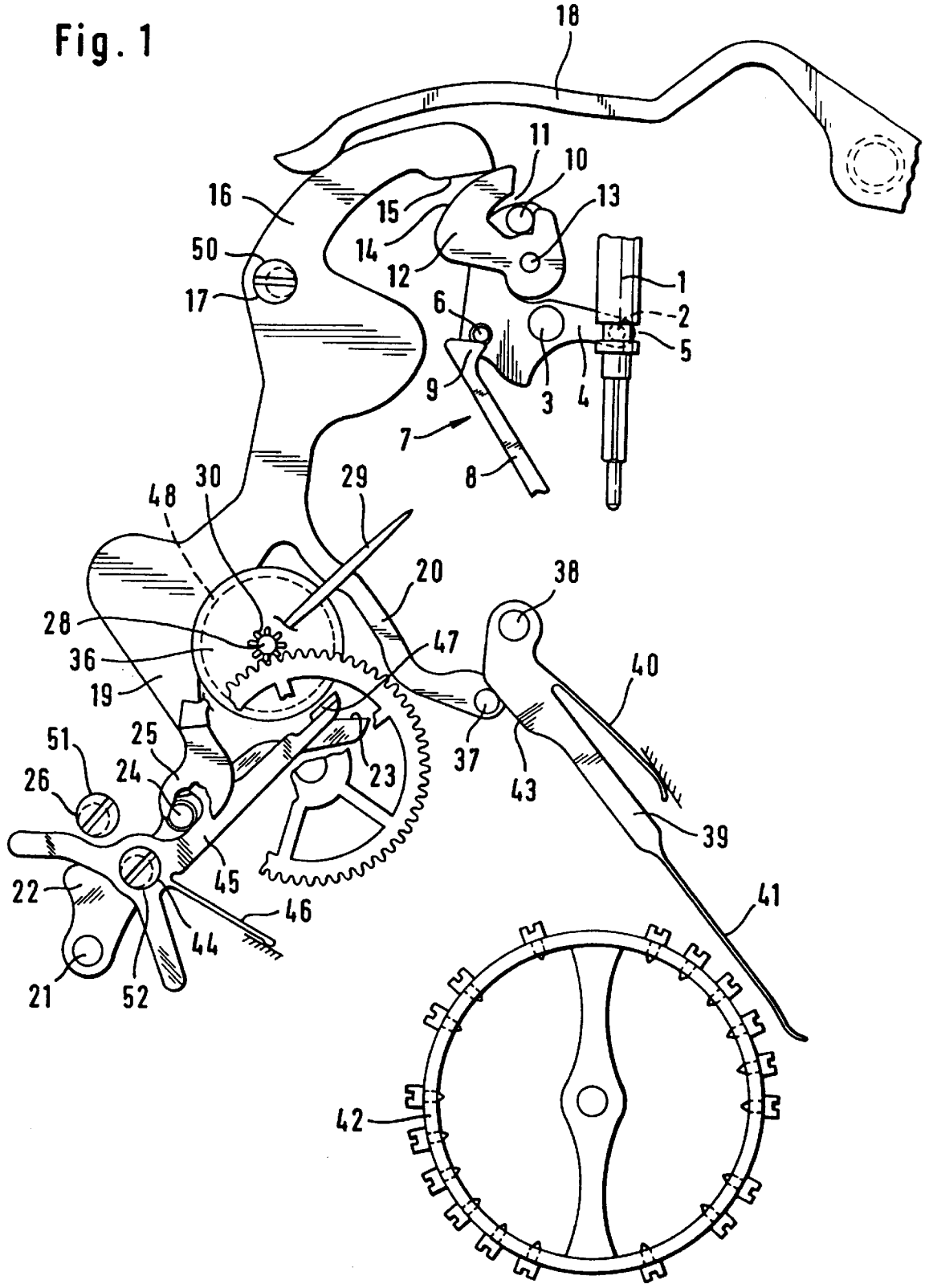
FIG. 1 shows the normal position of an arrangement for setting the minute hand of a timepiece which has a minute hand and second hand.
Figure 2:
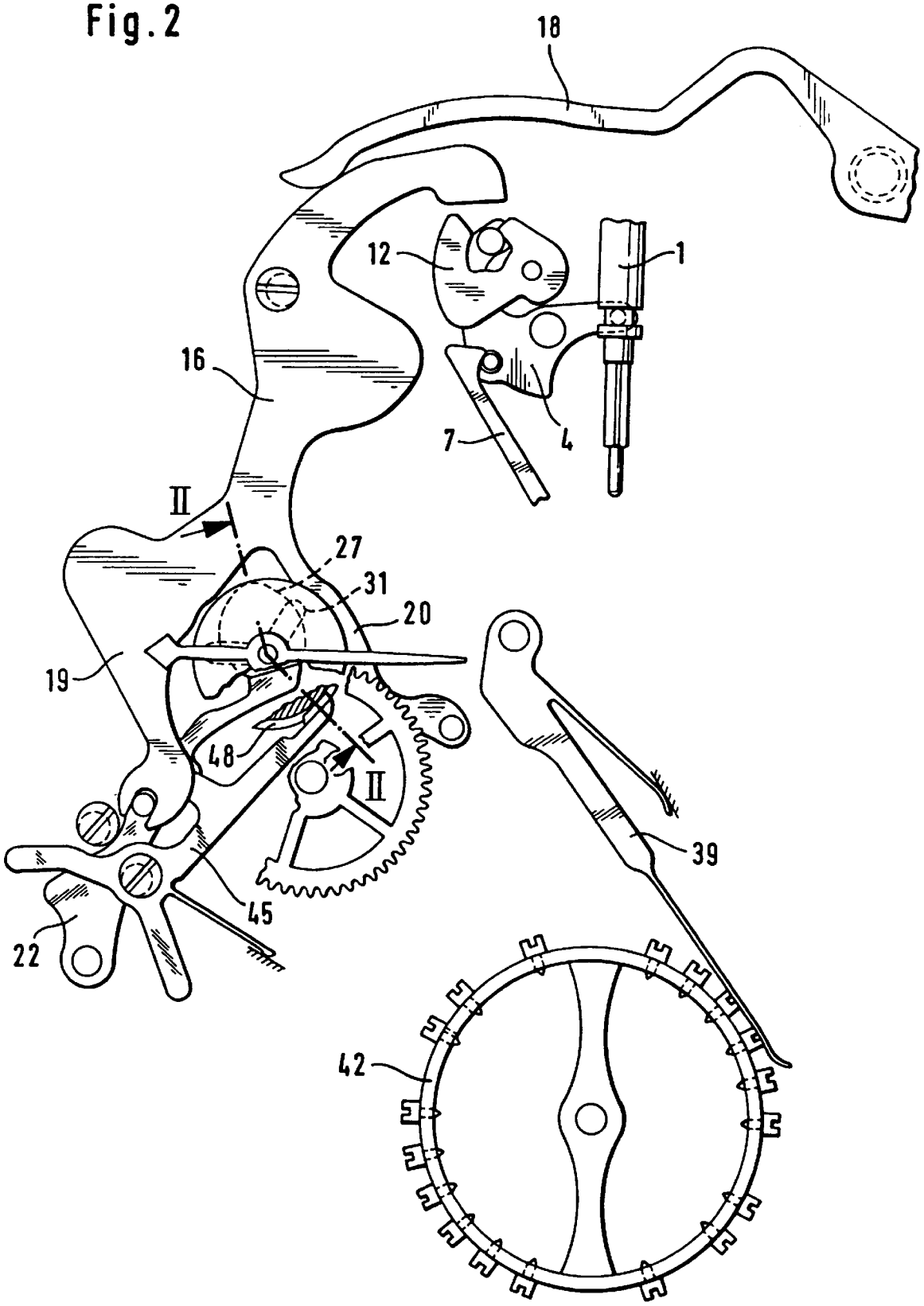
FIG. 2 shows the arrangement according to FIG. 1 in the setting position.

The arrangement illustrated has a setting stem 1 which can be displaced manually in the axial direction between a normal position (FIG. 1) and a setting position (FIG. 2).

The setting stem, in its setting position, is incorporated in a minute-hand drive (not illustrated) and, by virtue of rotation of the setting stem 1 about its axis of rotation, can adjust the position of a minute hand (not illustrated either).

A pin 2 of an angle lever 4, which can be pivoted about a spindle 3, engages, transversely with respect to the axis of rotation of the setting stem 1, in an annular groove 5 formed around the periphery, in the radial direction, of the setting stem 1. By virtue of axial displacement of the setting stem 1, the angle lever 4 is pivoted about its spindle 3 via the pin 2.

A catch spring 7 acts on an extension 6, which projects from the angle lever 4, such that, depending on its pivot position, the angle lever 4 is forced into its rest position or its operation-initiating position or its hand setting position. The catch spring 7 comprises a spring arm 8 which is arranged in a fixed manner at one end and has a tooth 9 at its other end.

Figure 3:
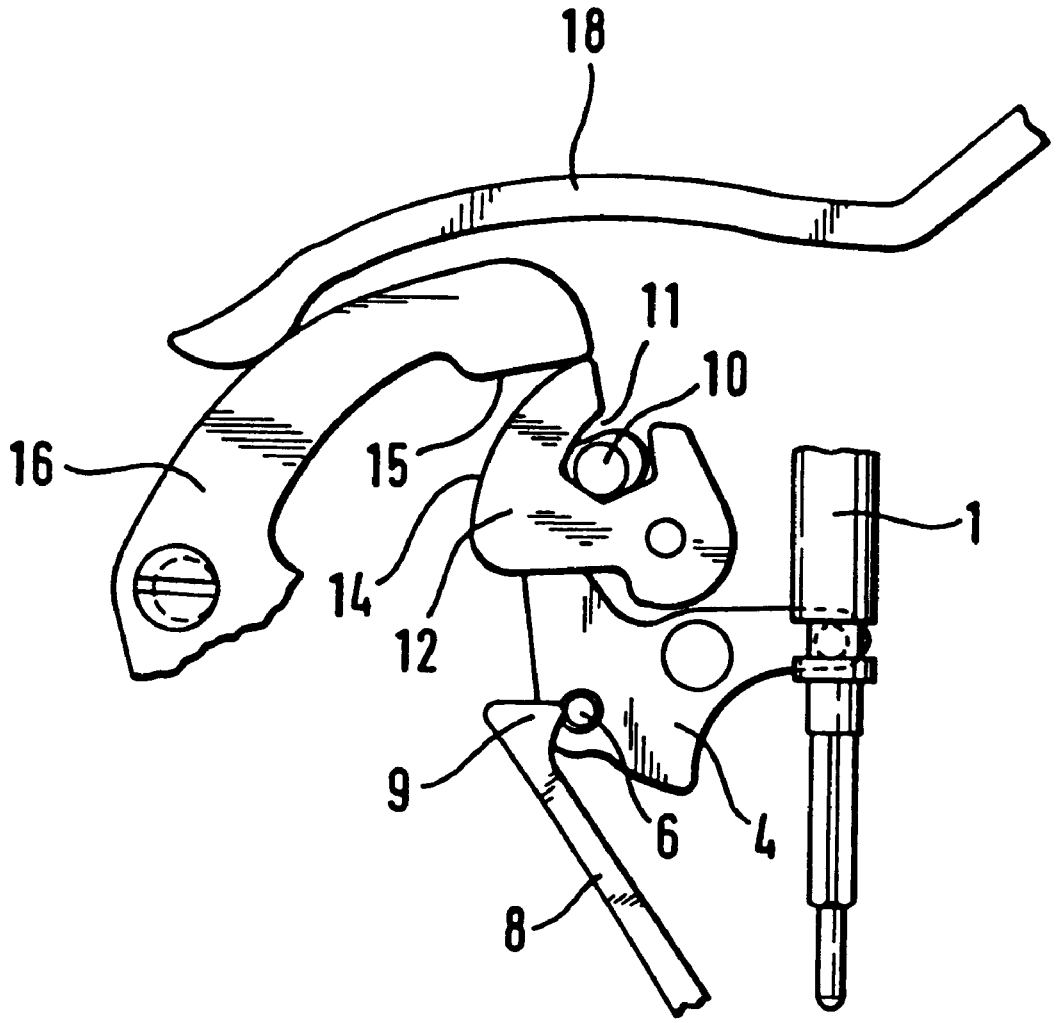
FIG. 3 shows a detail of the arrangement according to FIG. 1 in an intermediate position between the normal position and setting position.
Figure 4:
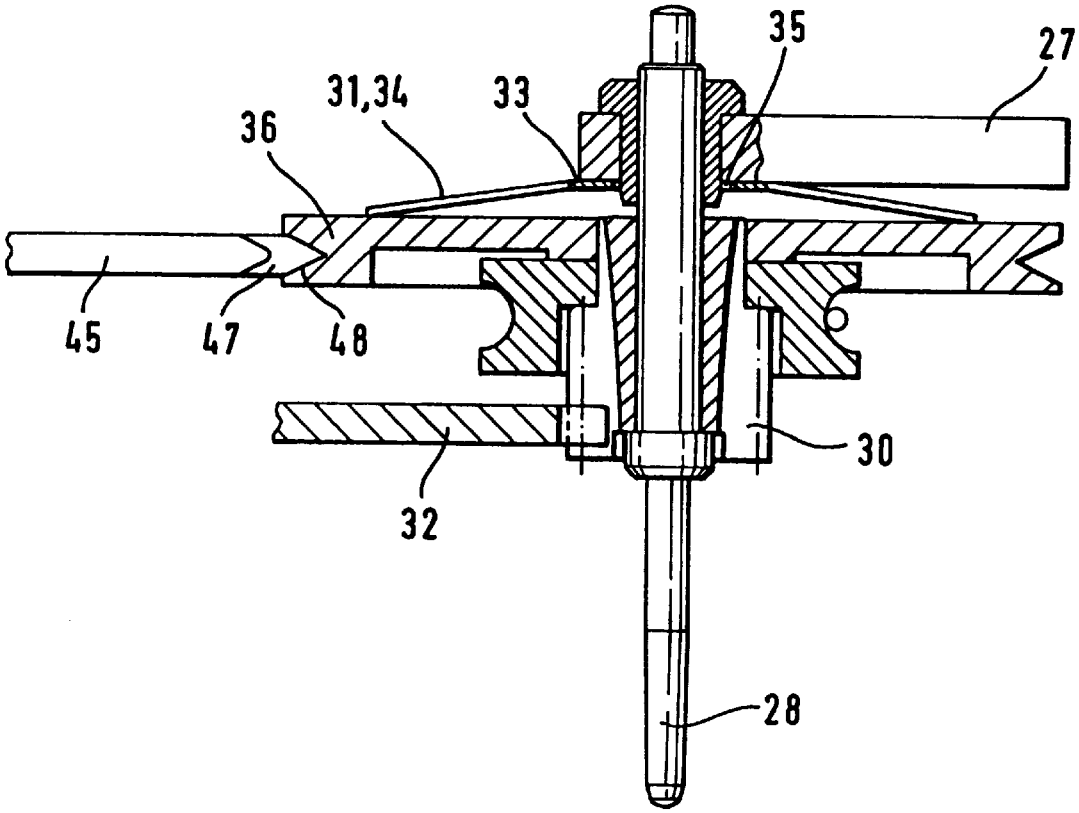
FIG. 4 shows a side view in the section along line II—II in FIG. 2.

In the rest position the tooth 9 butts against the extension 6 by way of one flank, and in the operation-initiating position it butts against the same by way of its other flank. Upon pivoting of the angle lever 4, the spring arm 8 is deflected, with the result that the tooth 9 is moved beyond the extension 6 (FIG. 3).

On its lever arm opposite the setting stem 1, the angle lever 4 bears a stub 10 which engages in a groove 11 of a control plate 12.

The control plate 12 can be pivoted about a spindle 13 parallel to the spindle 3 of the angle lever 4, it being the case that the pivot path is limited by the ends of the groove 11, the stub 10 coming into abutment against said ends. In this case, the groove 11 is equidistant from the spindle 13.

The control plate 12 has a control curve 14 which is likewise equidistant from the spindle 13. This control curve 14, which is designed as an arc section, interacts with an activation surface 15 of a pivot lever 16 which can be pivoted about a pivot spindle 17 by the control curve 14.

For this purpose, the activation surface 15 is designed as a slope which is inclined with respect to a radial line to the pivot spindle 17 of the pivot lever 16. In this case the control curve 14 and activation surface 15 are inclined with respect to one another at such an angle that self-locking of the two parts sliding on one another is ruled out.

The pivot lever 16, by way of an activation surface 15, is forced permanently in the direction of the control curve 14 by the action of the free end of a prestressed spring arm 18 and, in the normal position (FIG. 1), rests on the control curve 14 in a prestressed manner by way of the activation surface 15.

However sliding of the control curve 14 along the activation surface 15, and thus pivoting of the pivot lever 16, is only possible when the angle lever 4 is pivoted by virtue of the setting stem 1 being moved out of the normal position into the setting position. In this case, the control curve 14, under the action of the force of the spring arm 18 on the pivot lever 16, slides along the activation surface 15 until, at the end of its pivot path, it is disengaged from the activation surface 15, since the ability of the pivot lever 16 to pivot is limited.

The pivot lever 16 is designed as a two-armed lever, on one lever arm of which the activation surface 15 is arranged. The other lever arm is branched into a zero setting arm 19 and a stopping arm 20. A zero setting lever 22 is arranged in a plane parallel to the zero setting arm 19, such that it can be pivoted about a spindle 21 parallel to the pivot spindle 17. In this case, the spindle 21 is located at one end of the zero setting lever 22, while arranged at the other end of the zero setting lever 22, directed in the pivot direction, is a setting surface 23.

Arranged approximately centrally between the setting surface 23 and spindle 21, on the zero setting lever 22, is a pin 24 which extends parallel to the spindle 21 and projects into the pivot region of the pivot lever 16. The pin 24 has a fork-shaped end 25 of the zero setting arm 19 engaging around it, and the pivot position of the zero setting lever 22 is thus determined by the zero setting arm 19.

When the pivot lever 16 is pivoted out of the normal position into the zero setting position, the fork-shaped end 25 of the zero setting arm 19 pivots the zero setting lever 22 into abutment against a stop 26. In this case, the setting surface 23 passes into the region of a heart-cam plate 27 which is arranged in a rotationally fixed manner on a seconds stem 28 parallel to the spindle 21.

By virtue of the action of the setting surface 23 on the radially peripheral lateral surface of the heart-cam plate 27, the heart-cam plate 27 is pivoted until the setting surface 23 reaches the location which is nearest the axis of rotation of the heart-cam plate 27 in the radial direction. As a result, however, the second hand 29, which is arranged on the seconds stem 28, is also moved into its zero position.

This pivoting of the seconds stem 28 can be carried out without obstruction since a seconds-display drive mechanism 30 of the wheel train of the movement mechanism is mounted on the seconds stem 28 in a freely rotatable manner and is only coupled to the seconds stem 28 by a coupling spring 31 with a force fit. As a result, by virtue of the force fit of the coupling spring 31 being overcome, the seconds stem 28 can be rotated without being blocked by the seconds-display drive mechanism 30.

The coupling spring 31 is of leaf-spring design with a central part 33, from which there project three radially extending spring arms 34 which are angled out of the plane of the central part 33. The coupling spring 31 is arranged on the seconds stem 28 by way of a bore 35 formed in the central part 33. In this case, the central part 33 is supported on the heart-cam plate 27, while the free ends of the spring arms 34 are supported with prestressing on a radially directed, flange-like widened section 36 of the seconds-display drive mechanism 30. By virtue of the heart-cam plate 27 and seconds-display drive mechanism 30 being rotated relative to one another with sufficient force, it is possible to overcome the force-fit coupling between the central part 33 of the coupling spring 31 and the heart-cam plate 27 and the seconds-display drive mechanism 30.

At its free end, the stopping arm 20 of the pivot lever 16 has a pin 37 which projects transversely with respect to the pivot plane of said lever. This pin 37 interacts, counter to the force of a spring 40, with a stopping lever 39 which can be pivoted about a pivot spindle 38. One, free end of the stopping lever 39 is designed as a spring arm 41 and, by virtue of the stopping lever 39 being pivoted by the spring 40, can be moved into abutment against the radially peripheral contour of a balance wheel 42. The resilient abutment of the spring arm 41 against the balance wheel 42 means that the rotary movement of the latter can be stopped. In the normal position of the pivot lever 16, the pin 37 of the stopping arm 20 butts against a stop surface 43 of the stopping lever 39 and thus keeps the spring arm 41 of the stopping lever 39, counter to the force of the spring 40, at a distance from the balance wheel 42, with the result that the latter can move freely.

By virtue of the pivot lever 16 being pivoted into the zero setting position, the pin 37 of the stopping arm 20 is disengaged from the stopping lever 39, with the result that the spring 40 pivots the stopping lever 39 and the latter, by way of its spring arm 41, comes into abutment, with prestressing, against the radially peripheral contour of the balance wheel 42 and blocks the movement of the balance wheel 42. The movement mechanism of the timepiece is also put out of operation as a result.

A blocking lever 45 is arranged such that it can be pivoted about a pivot spindle 44 parallel to the spindle 21 of the zero setting lever 22.

By virtue of a blocking spring 46, the blocking lever 45 can be moved, by way of its free end, against the radially peripheral lateral surface of the flange-like widened section 36. At this free end, the blocking lever 45 has an approximately V-shaped blocking region 47 by means of which it can be pivoted into an approximately correspondingly V-shaped groove 48, which is formed around the periphery, in the radial direction, of the radially peripheral lateral surface of the widened section 36.

In the normal position (FIG. 1), the pin 24 of the zero setting lever 22 keeps the blocking region 47 of the blocking lever 45 disengaged from the groove 48 counter to the force of the blocking spring 46.

If the zero setting lever 22 is pivoted, by the pivot lever 16, out of the normal position into the zero setting position, then the blocking lever 45, which is supported on the pin 24, follows until it engages in the groove 48 by way of its blocking region 47 and thus blocks the seconds-display drive mechanism 30.

The zero setting lever 22 is then moved on further by the pivot lever 16 until it comes to rest, by way of its setting surface 23, on the heart-cam plate 27 and rotates the latter until the setting surface 23 butts against the radially lowest point of the heart-cam plate 27 and the second hand 29 is thus located in its zero position.

In this case, the seconds-display drive mechanism 30 is blocked before the heart-cam plate 27 is adjusted.

For the purpose of setting the timepiece to the right time, first of all the setting stem 1 is drawn upward, by means of a winder (not illustrated), out of the normal position, which is illustrated in FIG. 1, into the setting position, which is illustrated in FIG. 2. As a result, the angle lever 4 is pivoted in the counterclockwise direction and transmits its movement to the control plate 12. Until the intermediate position, which is illustrated in FIG. 3, has been reached, the angle between the control curve 14 and the activation surface 15 is such that there is self-locking between the two abutting parts. As the control curve 14 is pivoted further, the pivot lever 16 is also pivoted, with the result that the angle between the control curve 14 and activation surface 15 changes such that self-locking of these two abutting parts is now ruled out. Under the force of the spring arm 18, the pivot lever 16 then automatically slides along the control curve 14 by way of its activation surface 15 and, in the process, pivots such that it moves over the pin 24 of the zero setting lever 22 by way of its fork-shaped end 25 and releases the blocking lever 45, with the result that the latter follows the zero setting lever 22 under the action of the blocking spring 46.

As a result, first of all the seconds-display drive mechanism is blocked. Then the zero setting lever 22 acts on the heart-cam plate 27 by way of its setting surface 23 and, overcoming the frictional forces of the coupling spring 31, said heart-cam plate 27 is moved directly into the zero position and is secured there.

At the same time, the stopping lever 39 is pivoted, by way of its spring arm 41, against the balance wheel 42 by the stopping arm 20 of the pivot lever 16 and stops said balance wheel.

Then, by virtue of rotation of the setting stem 1, a minute hand (not illustrated) and an hour hand (not illustrated either) are set to the correct time, e.g. of the next time signal.

When this time signal sounds, then the setting stem 1 is displaced into the normal position again, as a result of which the angle lever 4 and, following passage through a certain free path of the angle lever 4, via the pivot plate 12, the pivot lever 16 and the zero setting lever 22, by way of its setting surface 23, are forced back into their normal positions, as a result of which the heart-cam plate 27 is released.

The pin 24 then lifts the blocking lever 45, with the result that the blocking region 47 of the latter is moved out of the groove 48 and the seconds-display drive mechanism 30 is released.

At the same time, the stopping arm 20 acts on the stop surface 43 of the stopping lever 39, lifts off the spring arm 41 of the latter from the balance wheel 42 and releases said balance wheel.

As a result, the movement mechanism of the timepiece runs freely and the hands move synchronously.

For the purpose of adjusting the lever paths, use is made of an eccentric 50 on the pivot spindle 17 for the pivot lever 16, of an eccentric 51 on the stop 26 of the zero setting lever 22, and of an eccentric 52 on the pivot spindle 44 of the blocking lever 45.

Of course, the seconds-display drive mechanism which is to be blocked need not necessarily be the drive mechanism which is seated on the seconds stem; rather, it is also possible for it to be a gear wheel which is in the vicinity of said drive mechanism and is located in the wheel train which leads to said drive mechanism. However, it is best if it is the drive mechanism which is seated on the seconds stem which is blocked.

What is claimed is:

1. An arrangement for setting the minute hand of a timepiece, the timepiece comprising:

at least a minute hand and a second hand, a setting stem which is movable axially out of a normal position into a setting position, a zero setting drive for moving the second hand into a zero position thereof, and a spring-force-operated drive for operating the zero setting drive of the second hand to move the second hand into said zero position;

wherein the spring-force-operated drive is responsive to a position of said setting stem for initiating operation of the zero setting drive upon movement of said setting stem out of the normal position toward the setting position.

2. The arrangement as claimed in claim 1, wherein the setting stem (1) is a minute setting stem of the timepiece and the setting position is the minute setting position, in which, by rotation of the setting stem (1), the minute hand can be driven such that it can be moved manually.

3. The arrangement as claimed in claim 1, wherein, when the setting stem (1) is located in the setting position, the second hand (29) can be arrested in the zero position by the zero setting drive.

4. The arrangement as claimed in claim 1, wherein, by virtue of the setting stem (1), when the latter is moved axially out of the normal position in the direction of the setting position a lever can be driven such that it can be pivoted, about a spindle (3), out of a rest position into a position in which operation of the drive is initiated.

5. The arrangement as claimed in claim 4, wherein the lever is a two-armed lever.

6. The arrangement as claimed in claim 5, wherein the lever is an angle lever (4).

7. The arrangement as claimed in claim 1, wherein the zero setting drive is a cam-plate drive, of which the cam plate is arranged fixedly on a seconds stem (28), which bears the second hand (29), and, upon movement of the setting stem (1) in the direction of the setting position, can be driven by the spring-force-operated drive such that it can be moved into the zero position by a zero setting lever (22).

8. The arrangement as claimed in claim 7, wherein the cam-plate drive is a heart-cam zero setting drive.

9. The arrangement as claimed in claim 7, wherein the zero setting lever (22) is a lever which can be pivoted about a spindle (21) parallel to the seconds stem (28) and which acts on the radially peripheral lateral surface of the cam plate.

10. The arrangement as claimed in claim 7, wherein the zero setting drive has a pivot lever (16) which can be pivoted, about a pivot spindle (17) parallel to the seconds stem (28), between a normal position and a zero setting position, which is forced into its zero setting position by spring action and which can act on the zero setting lever (22) such that it can be moved out of its normal position, in which it is spaced apart from the cam plate, against the cam plate.

11. The arrangement as claimed in claim 1, wherein, by virtue of the lever, a control plate (12) can be driven such that it can be pivoted about a spindle (13) parallel to the spindle (3) of the lever, wherein the control plate (12) has a control curve (14) which can act on an activation surface (15) of a pivot lever (16), and the pivot lever (16) can be moved out of its normal position into its zero setting position counter to the action of a spring.

12. The arrangement as claimed in claim 11, wherein the control curve (14) and activation surface (15) are inclined with respect to one another at an angle at which self-locking is ruled out.

13. The arrangement as claimed in claim 12, wherein the control curve (14) is an arc which is equidistant from the spindle (13) of the control plate (12), and the activation surface (15) is a slope which is inclined with respect to a radial line to a pivot spindle (17) of the pivot lever (16).

14. The arrangement as claimed in claim 13, wherein the control curve (14) is an arc section which, in the rest position, butts against the slope of the pivot lever (16) and, in a zero setting position, is disengaged from the slope of the pivot lever (16).

15. The arrangement as claimed in claim 11, wherein the control plate (12) can be pivoted freely relative to the lever over a certain distance.

16. The arrangement as claimed in claim 15, wherein arranged on the lever is a stub (10) which engages in a groove (11) which belongs to the control plate (12) and extends over the certain distance in the radial direction in relation to the spindle (13) of the control plate (12).

17. The arrangement as claimed in claim 15, wherein, depending on its pivot position, the lever is forced into its rest position or its hand setting position by the action of a catch spring (7).

18. The arrangement as claimed in claim 1, wherein by virtue of the setting stem, when the latter is moved out of the normal position into the setting position, a stopping device can be actuated for the purpose of stopping the movement mechanism of the timepiece.

19. The arrangement as claimed in claim 18, wherein the stopping device can be actuated by the pivot lever (16).

20. The arrangement as claimed in claim 18, wherein the stopping device has a stopping lever (39) which can be driven such that it can be moved, by the pivot lever (16), between a normal position, in which it releases a balance wheel (42) of the timepiece, and a stopping position, in which it acts on the balance wheel (42) with a force fit.

21. The arrangement as claimed in claim 20, wherein the pivot lever (16) can act on the stopping lever (39) such that it forces said stopping lever away from the balance wheel (42) in the radial direction counter to the force of a spring (40).

22. The arrangement as claimed in claim 20, wherein, that region of the stopping lever which acts on the balance wheel (42) with a force fit is a spring arm (41).

23. The arrangement as claimed claim 1, wherein a seconds stem (28) is coupled to the movement mechanism of the timepiece with a force fit.

24. The arrangement as claimed in claim 23, wherein arranged between the seconds stem (28) and a seconds-display drive mechanism (30) of the movement mechanism is a prestressed coupling spring (31) which butts against at least either the seconds stem (28) or the seconds-display drive mechanism (30) with a friction fit.

25. The arrangement as claimed in claim 24, wherein the seconds-display drive mechanism (30) is mounted on the seconds stem (28) in a freely rotatable manner.

26. The arrangement as claimed in claim 25, wherein the coupling spring (31) is arranged axially between the seconds stem (28) and seconds-display drive mechanism (30).

27. The arrangement as claimed in claim 26, wherein the coupling spring (31) is a spring which has one or more radially directed spring arms (34), of which one spring-arm end is arranged on the seconds stem (28) and the second spring-arm end is supported on the end side of the seconds-display drive mechanism (30).

28. The arrangement as claimed in claim 27, wherein the second spring-arm end is supported on a radially directed, flange-like widened section (36) of the seconds-display drive mechanism (30).

29. The arrangement as claimed claim 1, wherein a seconds-display drive mechanism (30) has a blocking device which can be actuated, by the setting stem (1) being moved in the direction of the setting position, such that the seconds-display drive mechanism (30) is blocked before the second hand (29) is moved into the zero position.

30. The arrangement as claimed in claim 29, wherein the blocking device has a blocking lever (45) which can be pivoted about a pivot spindle (44) and which can act on a movable drive part of the seconds-display drive mechanism (30) with a force fit and/or form fit and/or friction fit.

31. The arrangement as claimed in claim 30, wherein the movable drive part is the flange-like widened section (36) of the seconds-display drive mechanism (30), of which the radially peripheral lateral surface can have the blocking lever (45) acting on it.

32. The arrangement as claimed in claim 31, wherein the radially peripheral lateral surface has a radially peripheral, approximately V-shaped groove (48) into which the blocking lever (45), which can be pivoted about the pivot spindle (44), parallel to the axis of rotation of the gear wheel (30), can be pivoted by an approximately correspondingly V-shaped blocking region (47).

33. The arrangement as claimed in claim 30, wherein the blocking lever (45) can be driven such that it can be pivoted by a pivot lever (16).

34. The arrangement as claimed in claim 30, wherein the pivot spindle (44) of the blocking lever (45) and a spindle (21) of a zero setting lever (22) are arranged axially with respect to one another, and the blocking engagement direction of the blocking lever (45) and the zero setting direction of the zero setting lever (22) are oriented in approximately the same way.

35. The arrangement as claimed in claim 34, wherein the action of a blocking spring (46) forces the blocking lever (45) both in the blocking engagement direction and against a pivot lever (16), such that the latter is forced into the zero setting position.

36. The arrangement as claimed in claim 35, wherein the action of the blocking spring (46) forces the blocking lever (45) into abutment against a stop of the pivot lever (16) or of the zero setting lever (22), wherein, when the blocking lever (45) and pivot lever (16) are respectively pivoted in the blocking engagement direction and the zero setting direction, the blocking lever (45) reaches the blocking position before the zero setting lever (22) reaches the zero setting position.

37. An arrangement for setting the minute hand of a timepiece, the timepiece comprising:

a balance wheel, at least a minute hand and a second hand, a setting stem which is movable axially out of a normal position into a setting position, a zero setting drive including a pivot lever extending from a location of said setting stem to a location of said second hand for moving the second hand into a zero position thereof, and a spring-force-operated drive for operating the zero setting drive of the second hand to move the second hand into said zero position;

wherein the spring-force-operated drive is responsive to a position of said setting stem communicated by said pivot lever for initiating operation of the zero setting drive upon movement of said setting stem out of the normal position toward the setting position, positions of said pivot lever serving to enable said spring-force-operated drive while stopping said balance wheel or disabling said spring-forceoperated drive while releasing said balance wheel.

* * * * *